US007675417B2

(12) United States Patent
Eastwood

(10) Patent No.: US 7,675,417 B2
(45) Date of Patent: Mar. 9, 2010

(54) FENCE ALARM

(76) Inventor: James Eastwood, 17 S. 3rd St., Petersburg, AK (US) 99833

( * ) Notice: Subject to any disclaimer, the term of this patent is extended or adjusted under 35 U.S.C. 154(b) by 308 days.

(21) Appl. No.: 11/818,734

(22) Filed: Jun. 15, 2007

(65) Prior Publication Data

US 2008/0309479 A1 Dec. 18, 2008

(51) Int. Cl.
*G08B 13/26* (2006.01)

(52) U.S. Cl. ..... 340/564; 340/539.1; 340/539.13; 340/506; 340/531; 340/541; 340/825.36; 340/825.49

(58) Field of Classification Search ..... 340/564, 340/539.1, 539.13, 506, 531, 541, 550, 505, 340/573.1, 825.36, 825.49
See application file for complete search history.

(56) References Cited

U.S. PATENT DOCUMENTS 4,450,434 A * 5/1984 Nielsen et al. ..... 340/506
4,725,825 A * 2/1988 McKean ..... 340/660
4,829,287 A * 5/1989 Kerr et al. ..... 340/541
5,982,291 A * 11/1999 Williams et al. ..... 340/635

* cited by examiner

*Primary Examiner*—Hung T. Nguyen

(57) ABSTRACT

A fence alarm for detecting and identifying a location in a fence which is broken. The fence alarm comprises a power source for providing power to the alarm components, the components including a plurality of detectors, each detector providing termination of a segment of the fence, each detector having a unique identifier, whereby the detector outputs its unique identifier when the segment is broken. The alarm includes a transmitter for transmitting the unique identifier, by means of an integrated antenna, which is received by a receiver. The fence alarm may also have computing or logic elements to provide additional storage or processing of signals, or data associated with the fence or the alarm.

1 Claim, 6 Drawing Sheets

FENCE ALARM

FIELD

The present invention relates in general to farm and home products; more specifically the present invention is an alarm utility system for detecting and alerting upon the break of a fence.

BACKGROUND

A fence is a freestanding structure designed to restrict or prevent movement across a boundary. It is generally distinguished from a wall by the lightness of its construction: a wall is usually restricted to such barriers made from solid brick or concrete, blocking vision as well as passage.

Fences are constructed for several purposes, including: agricultural fencing, to keep livestock in or predators out, to provide privacy, temporary fencing, to provide public safety and security on construction sites, security fencing, to prevent trespassing or theft and/or to keep children and pets from wandering away, decorative fencing, to enhance the appearance of a property, garden or other landscaping.

Fences are ubiquitous. While some are merely decorative, most all serve a purpose-to retain or restrain. All sorts of animals are kept within fences on farms and within home yards. Children are kept within yards and are kept out of harms way by fences.

Therefore, when a fence breaks, it is extremely important to know of the event.

OBJECTS

According to the requirement for alerts when a fence is broken, herein is disclosed a device and method for alerting an owner or user of a fence. The device and method disclosed herein is designed and made with the object and benefit of a fence alarm that is simple to install and use.

Another object is a device and method that is reliable and robust.

And yet another object is a device and method that is inexpensive to acquire and use.

Other benefits and advantages of the invention will appear from the disclosure to follow. In the disclosure reference is made to the accompanying drawings, which form a part hereof and in which is shown by way of illustration a specific embodiment in which the invention may be practiced. This embodiment will be described in sufficient detail to enable those skilled in the art to practice the invention, and it is to be understood that other embodiments may be utilized and that structural changes may be made in details of the embodiments without departing from the scope of the invention.

SUMMARY

According to the aforementioned objects and benefits, herein is disclosed a fence alarm system for detecting and identifying a location in a fence which is broken.

The fence alarm system comprises an alarm transmission element and an alarm receiving element.

The fence alarm transmission element is made in a compact form and is usually mounted atop a post during the course of the fence. The alarm transmission element is configured to accept two independently conducting current carriers, each carrying a miniscule amount of current. The current carriers are integrated with the fence and, when broken (with the fence), the termination of current within the carriers activate a detector within the alarm. Each of the two detectors, each associated with an independent conductor, detect the break and provide a unique code, which is transmitted to a receiver in the alarm receiver element. The receiver decodes the received signal and, upon examination of the code, determines where the fence was broken.

The fence alarm transmission element comprises: (1) a power source for providing power to the alarm components, the components including (2) a plurality of detectors, each detector providing termination of a segment of the fence, each detector having a unique identifier, whereby the detector outputs its unique identifier when the segment is broken; (3) a transmitter for transmitting the unique identifier, by means of an integrated antenna, which is received by a receiver.

The fence alarm receiving element may also have computing or logic elements to provide additional storage or processing of signals, or data associated with the fence or the alarm.

DETAILED DESCRIPTION

An Exemplary Embodiment

Figure 1A:
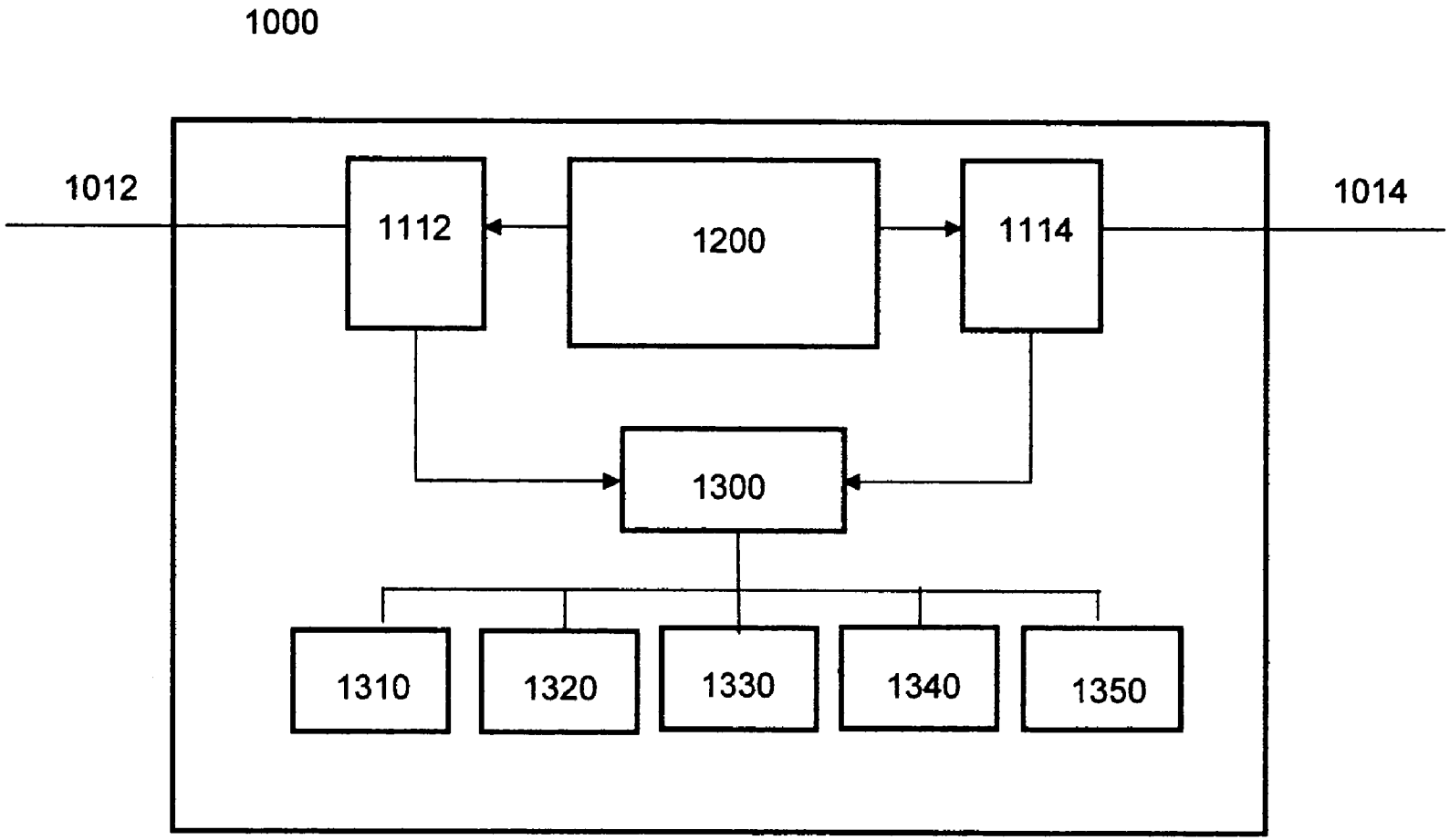
FIG. 1A shows a block diagram of the fence alarm transmission element.

Referring to FIG. 1A, a fence alarm transmission element 1000 includes a first interrogator 1012 (line break detector) and a second interrogator 1014, a transponder 1300, and a power supply 1200. The transponder 1300 may include a micro-controller 1310, a transmitter 1320, a receiver 1330, and a shared transmit/receive antenna 1340. The transmitter 1320 may be an RFID, which may be passive (having no on-board power source, such as a battery), or may be active and includes at least an antenna 1340, and may include an application specific integrated circuit (ASIC) 1350.

Alternatively, the fence alarm transmission element transponder may comprise circuits and electronics adapted to communicate over a cellular network An electrical circuit is associated with, or is made part of, the fence. Each fence alarm 1000 electrically accepts two circuits 1012 and 1014; in general a fence alarm 1000 is positioned on a post or fence support in between the two circuits 1012 and 1014.

When a circuit 1012 or 1014 associated with the fence breaks—indicating a break in the fence—either one or both detectors 1112 or 1114 is activated depending upon which circuit is broken.

Assume, for example circuit 1012 is broken, then detector 1112 is activated, which then outputs a code unique to that detector 1012. The code is conveyed by electrical means to the transponder 1300. The transponder 1300 generates, by means of the transmitter 1320, generates an electromagnetic signal in a predetermined frequency using a means of modulation by the code that is known to a receiver stationed somewhere in reasonable proximity to the fence alarm 1000. The modulated signal is transmitted to the surrounding environment by means of the antenna 1340. Proximity is determined by the power 1200 available to the transmitter 1320 and the degree of modulated signal degradation due to the environs of the fence alarm.

The microcontroller 1310 may be used to control the timing and modulation scheme of the transmitter 1320.

The ASIC 1350 may implement or be used as part of an implementation of additional algorithms, which are used by the transmitter.

The transmit/receive frequency employed is generally application dependent. Commonly available proximity interrogation systems operate at frequencies in a range of 60 kHz to 5.8 GHz, and typically employ frequency modulation for data transmission.

The transmitter may be implemented as a radio-frequency identifier (RFID), which incorporates the code related to a detector, that is, an RFID may be associated with each detector. RFIDs are now described.

RFID

Microelectronics has made possible the use of low-cost, reliable transponder systems for electronic identification. Such transponder systems are often referred to as RFID tags, as it is generally assumed that their primary end application will be that of tagging a variety of goods. In the interest of cost savings and miniaturization, RFID tags are generally manufactured as integrated circuits.

An RFID system may consist of several components: tags, tag readers, edge servers, middleware, and application software. The purpose of an RFID system is to enable data to be transmitted by a mobile device, called a tag, which is read by an RFID reader and processed according to the needs of a particular application. The data transmitted by the tag may provide identification or location information, or specifics about the product tagged, such as price, color, date of purchase, etc. The use of RFID in tracking and access applications first appeared in 1932 and was used to identify friendly and un-friendly aircraft. RFID quickly gained use because of its ability to track moving objects.

Passive RFID Tags

Passive RFID tags have no internal power supply. The minute electrical current induced in the antenna by the incoming radio frequency signal provides just enough power for the CMOS integrated circuit (IC) in the tag to power up and transmit a response. Most passive tags signal by backscattering the carrier signal from the reader. This means that the aerial (antenna) has to be designed to both collect power from the incoming signal and also to transmit the outbound backscatter signal. The response of a passive RFID tag is not just an ID number (GUID); the tag chip can contain nonvolatile EEPROM for storing data. Lack of a power supply means that the device can be quite small: commercially available products exist that can be embedded under the skin. As of 2006, the smallest such devices measured 0.15 mm×0.15 mm, and are thinner than a sheet of paper (7.5 micrometers). The addition of the antenna creates a tag that varies from the size of postage stamp to the size of a post card. Passive tags have practical read distances ranging from about 2 mm (ISO 14443) up to a few meters (EPC and ISO 18000-6) depending on the chosen radio frequency and antenna design/size. Due to their simplicity in design they are also suitable for manufacture with a printing process for the antennas. Passive RFID tags do not require batteries, can be much smaller, and have an unlimited life span.

Semi-Passive RFID Tags

Semi-passive RFID tags are similar to passive tags except for the addition of a small battery. This battery allows the tag IC to be constantly powered, which removes the need for the aerial to be designed to collect power from the incoming signal. Aerials can therefore be optimized for the backscattering signal. Semi-passive RFID tags are thus faster in response, though less reliable and powerful than active tags.

Active RFID Tags

Unlike passive RFID tags, active RFID tags have their own internal power source which is used to power any ICs that generate the outgoing signal. Active tags are typically much more reliable (e.g. fewer errors) than passive tags due to the ability for active tags to conduct a communications session with a reader. Active tags, with their onboard power supply, also transmit at higher power levels than passive tags, allowing them to be more effective in "RF challenged" environments, or at longer distances. Many active tags have practical ranges of hundreds of meters, and a battery life of up to 10 years. Some active RFID tags include sensors such as temperature logging. Other sensors that have been married with active RFID include humidity, shock/vibration, light, radiation, temperature and atmospherics. Active tags typically have much longer range (approximately 300 feet) and larger memories than passive tags, as well as the ability to store additional information sent by the transceiver. At present, the smallest active tags are about the size of a coin and sell for a few dollars.

The Fence Alarm Receiving Element

Figure 1B:
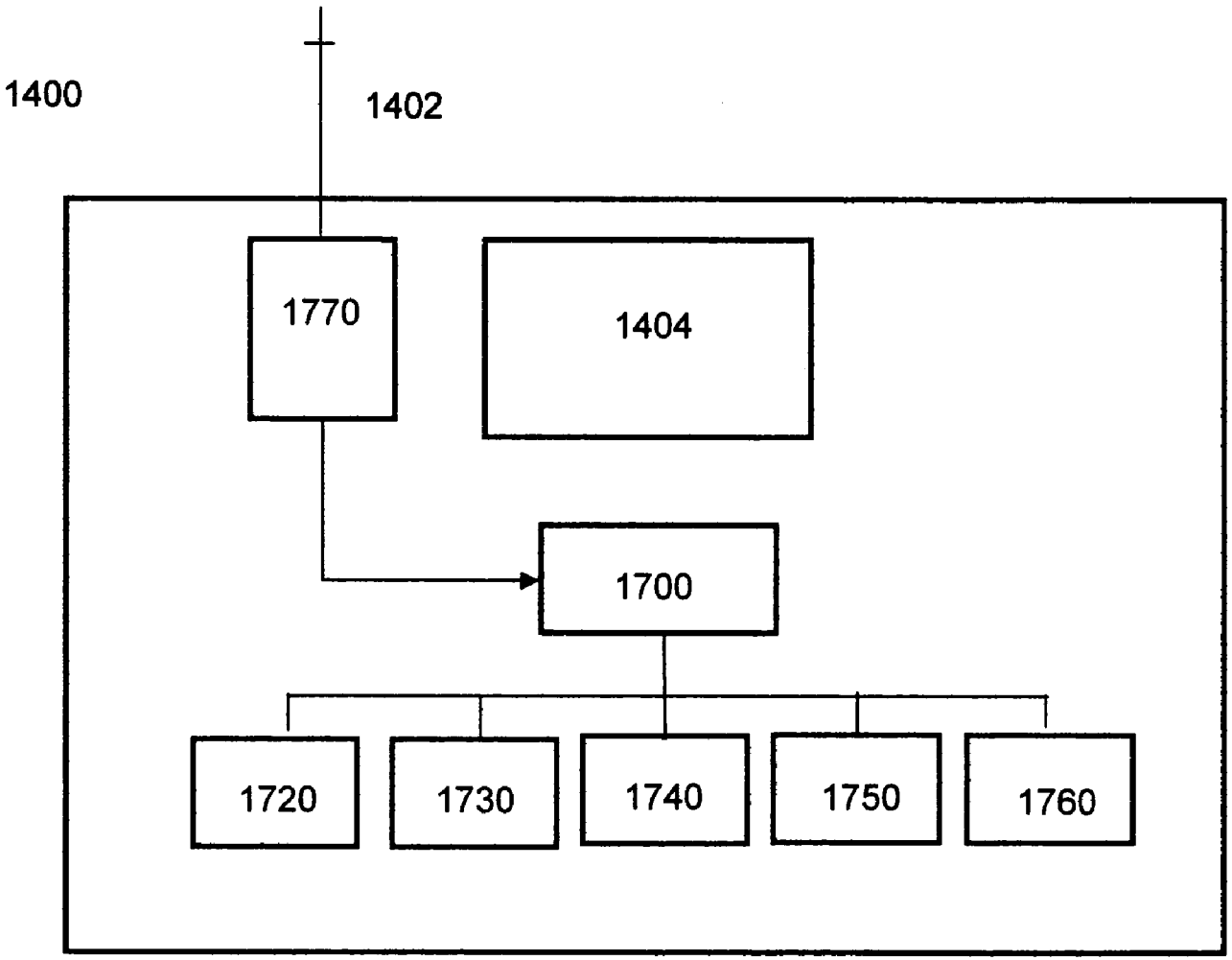
FIG. 1B is a depiction of the fence alarm receiving element, which has the computing environment shown in FIG. 1C.

The fence alarm receiving element 1400 is shown in FIG. 1B. In FIG. 1B, the receiving element 1400 comprises a power supply 1404, an antenna 1402 and a computing or logic element 1700, with peripheral or interface devices described as part of the computing environment in FIG. 1C. For example the computing or logic element 1700 has input/output and storage devices 1720, 1730, 1740, 1750 and 1760, which are described below.

The fence alarm receiving element is configured to be communications-compatible with the fence alarm transmitting element. That is, if the transmission element utilizes RFID components, the receiving element will also, or if the transmission element utilizes cellular network technology, the receiving element will also.

The computing element stores software 1720 comprising signal processing algorithms capable of decoding a signal received from a transmission element sending an alarm code. Storage and other software are capable of identifying the code and associating it with a section of a fence. Display devices on the receiving element 1400 can display a representation of the fence with the broken segment.

Computing Environment

Figure 1C:
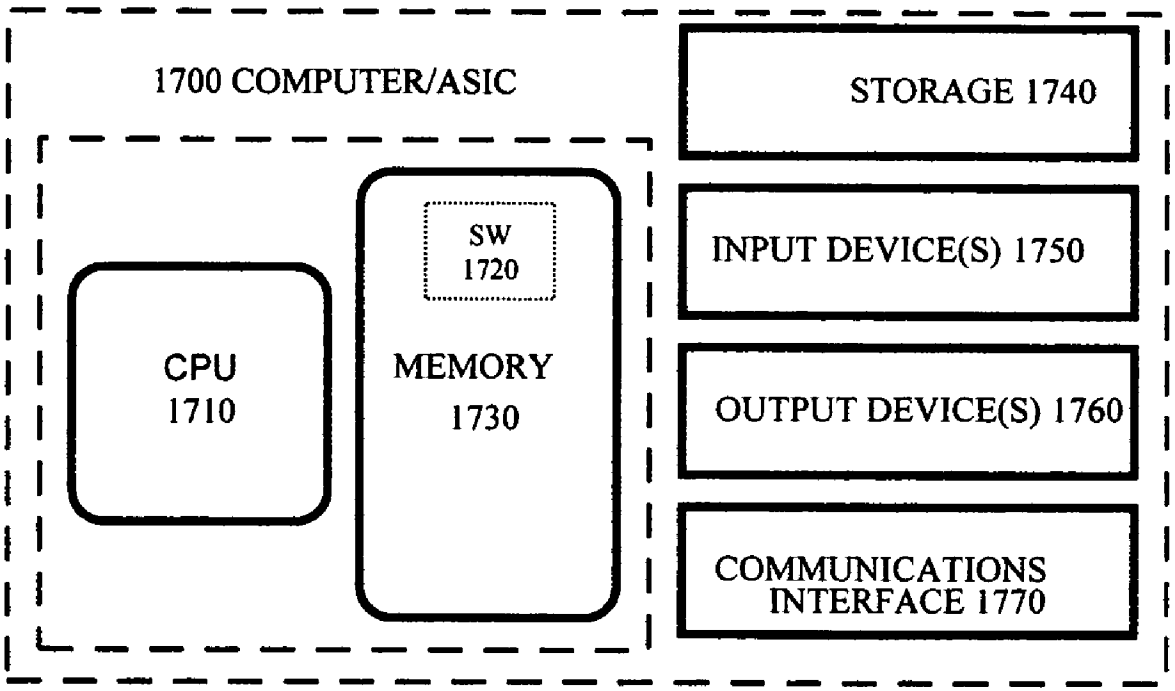
FIG. 1C is a computational, logic environment for the fence alarm receiving element.
Figure 1D:
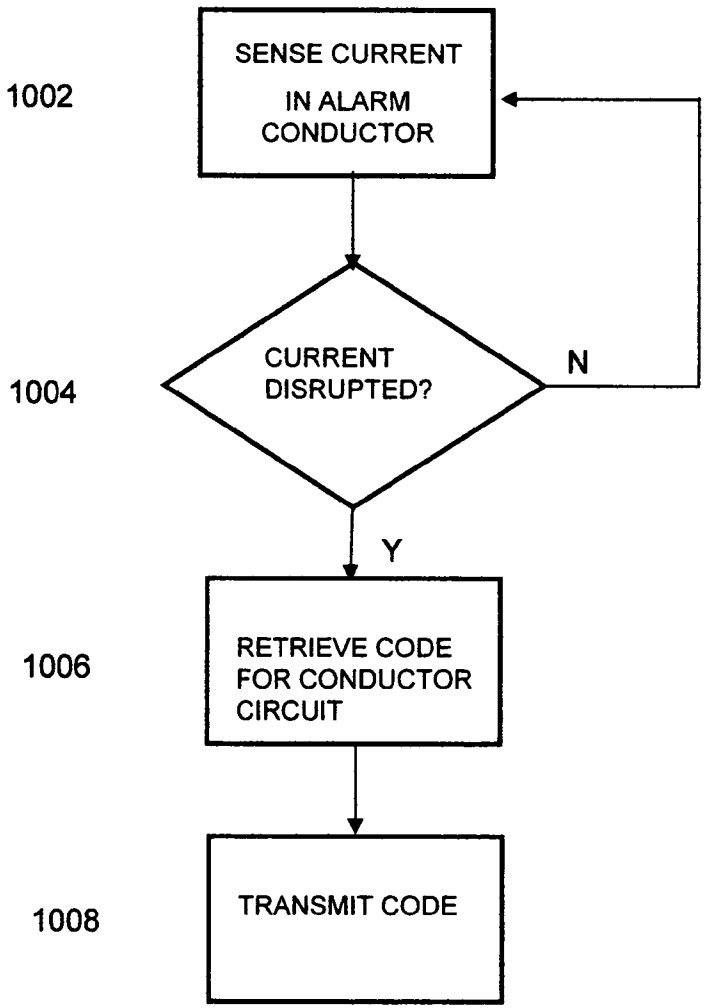
FIG. 1D depicts operation of the fence alarm system.

With reference to FIG. 1C, control, monitoring and activation of the fence alarm system may be implemented; for example, within a computing environment, which may be associated with the ASIC 1350 of FIG. 1A and the fence alarm receiving element of FIG. 1B, and includes at least one processing unit 1700 and memory 1730. In FIG. 1C, this most basic configuration is included within a dashed line. The processing unit 1700 executes computer-executable instructions and may be a real or a virtual processor. In a multiprocessing system, multiple processing units execute computer-executable instructions to increase processing power. The memory 1730 may be volatile memory (e.g., registers, cache, RAM), non-volatile memory (e.g., ROM, EEPROM, flash memory, etc.), or some combination of the two. The memory 1730 stores executable software-instructions and data 1720-written and operative to execute and implement the software applications required for an interactive environment supporting practice of the invention.

The computing environment may have additional features. For example, the computing environment includes storage 1740, one or more input devices 1750, one or more output devices 1760, and one or more communication connections or interfaces 1770. An interconnection mechanism (not shown) such as a bus, controller, or network interconnects the components of the computing environment. Typically, operating system software (not shown) provides an operating environment for other software executing in the computing environment, and coordinates activities of the components of the computing environment.

The storage 1740 may be removable or non-removable, and includes magnetic disks, CD-ROMs, DVDs, or any other medium which can be used to store information and which can be accessed within the computing environment. For example, the storage may store identity and description of the fence elements. The storage 1740 also stores instructions for the software 1720, and is configured, for example, to store data, database software systems, intermediate results and data generated from sensor inputs.

The input device(s) 1750 may be a touch input device such as a keyboard, mouse, pen, or trackball, a voice input device, a scanning device, or another device that provides input to the computing environment. For audio or video, the input device(s) may be a sound card, video card, TV tuner card, or similar device that accepts audio or video input in analog or digital form. The output device(s) 1760 may be a display, printer, speaker, or another device that provides output from the computing environment.

The communication interface 1770 enable the operating system and software applications to exchange messages over a communication medium with the sensor device, and servomechanisms in various instantiations of the apparatus of the invention. The communication medium conveys information such as computer-executable instructions, and data in a modulated data signal. A modulated data signal is a signal that has one or more of its characteristics set or changed in such a manner as to encode information in the signal. By way of example, and not limitation, the communication media include wired or wireless techniques implemented with an electrical, optical, RF, infrared, acoustic, or other carrier.

The communications interface 1770 is used to communicate with other devices. For example, the interface 1770 may be attached to a network, such as the Internet, whereby the computing environment 1000 interchanges command, control and feedback signals with other computers, devices, and machinery that are enabled to communicate via RFID or other signaling means.

Operation

Figure 2:
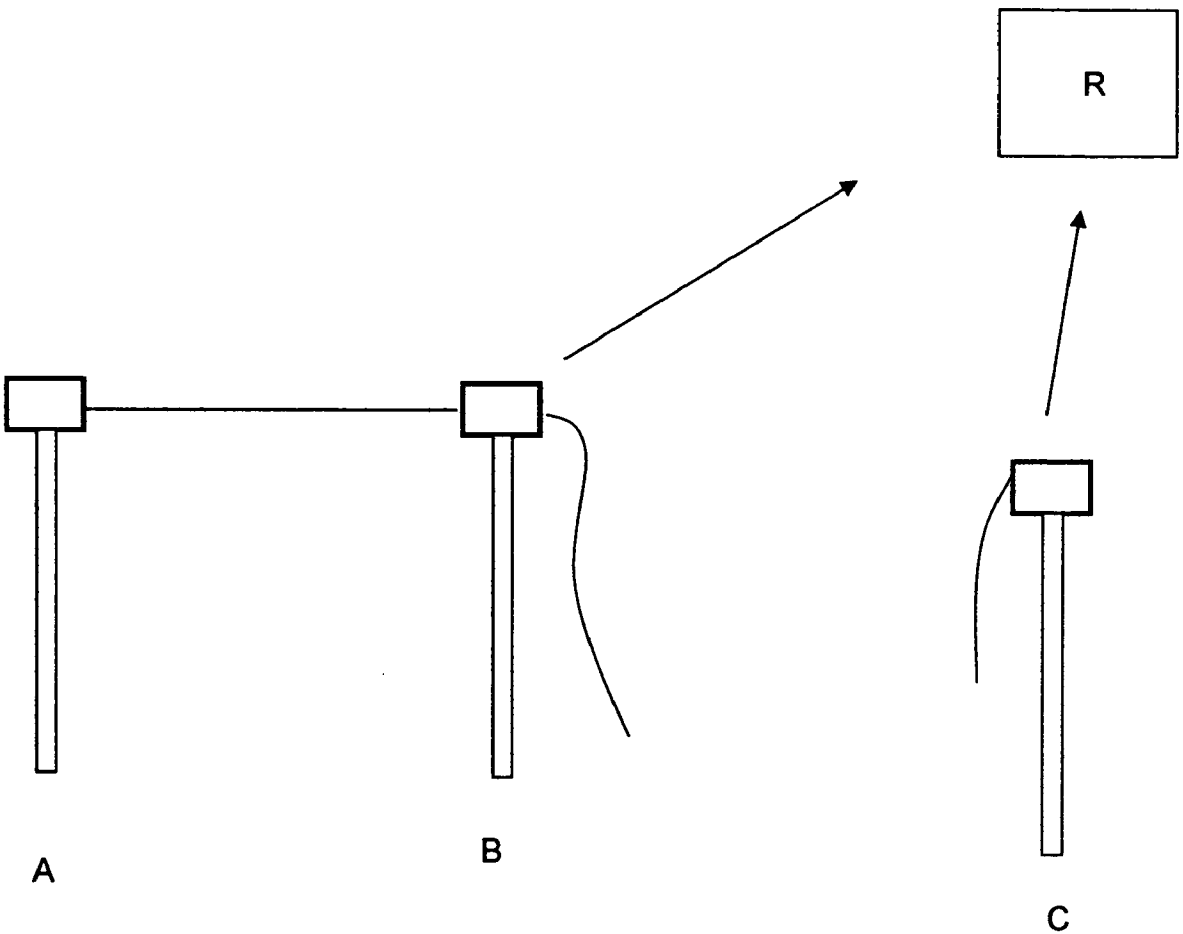
FIG. 2 illustrates an exemplary implementation of the fence alarm.

FIG. 2 depicts an exemplary operation of the fence alarm system. In FIG. 2 alarm transmission elements A, B and C are shown mounted on poles, with an electrical conductor stretched between each pair of transmission elements. The receiving element is shown as R.

In FIG. 2, the conductor between B and C is shown broken. According to the operation of the transmission elements, the detectors in B and C both detect the disruption in current flow. Each detector outputs its unique code and the transmitter in both B and C transmit the modulated code associated with the detector.

At the receiver R, each of the two signals are demodulated and decoded. Logic in the receiver R identifies the two codes and associates the two codes with fence locations. According to the computing environment recited above, the receiver has data storage associating each code to a corresponding segment of the fence. A display of the fence is shown on the receiving element, depicting the location of the break. An alarm is sounded and using external circuits such as the Internet, notification of the break is sent elsewhere.

Implementation

Figure 3:
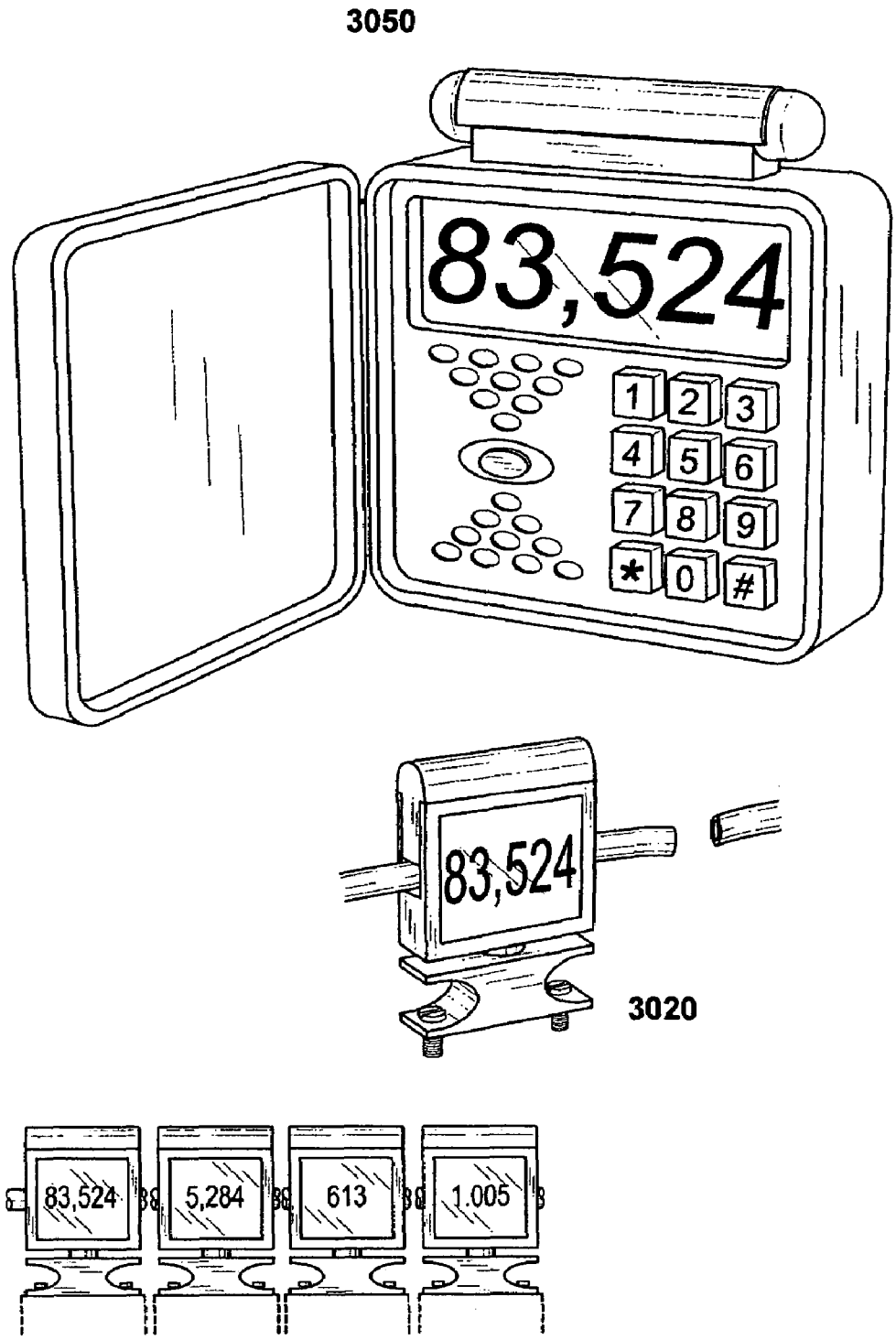
FIG. 3 depicts the components of the fence alarm system.

FIG. 3 shows an illustration of the invention, wherein the "caps" comprise the elements shown and described in FIG. 1A. In FIG. 3, the caps have a break detector monitoring a current-carrying trip wire that, when broken, cause the detector to activate. Upon activation of the detector, the internal transmitter is energized, when then transmits an identifier associated with the segment of trip-wire broken.

Further, the detection box, R (shown in FIG. 2), operating as a receiver of signals, receives the signal transmitted by the cap associated with the broken trip-wire. The detection or control box in FIG. 3 contains and implements the computing environment shown in FIG. 1B. The computing environment causes the control unit to display the fence segment broken and may initiate further alarm signals.

I claim:

1. A system for detecting a break in a fence, the system comprising:

an alarm transmission element having a first line break detector and a second line break detector, each line break detector having a unique code;

a first line terminating on the first line detector, and a second line terminating upon the second line detector;

means for providing electrical power to said first line and said second line;

a transponder for transmitting said unique code;

logic means for controlling said line break detectors and said transponder;

whereby, when a line is broken, said logic means acquires said unique code from the line break detector terminating the broken line, and said logic means provides said unique code to said transponder, which transmits said unique code identifying the broken line.

* * * * *